US009689154B2

(12) United States Patent
López Agüero

(10) Patent No.: US 9,689,154 B2
(45) Date of Patent: Jun. 27, 2017

(54) TWO-LEVEL WATER FLUSHING DEVICE FOR TOILETS

(71) Applicant: Carlos Enrique López Agüero, Lima (PE)

(72) Inventor: Carlos Enrique López Agüero, Lima (PE)

( * ) Notice: Subject to any disclaimer, the term of this patent is extended or adjusted under 35 U.S.C. 154(b) by 155 days.

(21) Appl. No.: 14/426,372

(22) PCT Filed: Sep. 9, 2013

(86) PCT No.: PCT/PE2013/000009

§ 371 (c)(1),
(2) Date: Mar. 5, 2015

(87) PCT Pub. No.: WO2014/046557

PCT Pub. Date: Mar. 27, 2014

(65) Prior Publication Data

US 2015/0225935 A1 Aug. 13, 2015

(30) Foreign Application Priority Data

Sep. 7, 2012 (PE) ..... 001463-2012/DIN

(51) Int. Cl.

| | |
|---|---|
| ***E03D 1/14*** | (2006.01) |
| ***E03D 1/30*** | (2006.01) |
| ***E03D 1/35*** | (2006.01) |
| ***E03D 5/092*** | (2006.01) |

(52) U.S. Cl.
CPC ..... *E03D 1/142* (2013.01); *E03D 1/306* (2013.01); *E03D 1/35* (2013.01); *E03D 5/092* (2013.01)

(58) Field of Classification Search
CPC E03D 1/142; E03D 1/306; E03D 1/35; E03D 5/092
USPC ..... 4/327
See application file for complete search history.

(56) References Cited

U.S. PATENT DOCUMENTS 3,186,007 A * 6/1965 Falotico ..... E03D 1/142 4/327
7,591,027 B2 * 9/2009 Scruggs ..... E03D 1/306 4/327

* cited by examiner

*Primary Examiner* — Tuan N Nguyen

(57) ABSTRACT

The invention relates to a two-level water flushing device for toilets (10), which allows the user to easily select between either a partial flush for liquid waste or a full flush for solid waste. The device (10) can be easily installed without requiring the toilet cistern (11) to be modified in any way. The device consists of five main parts: a modified overflow pipe (15), a full flush valve (30) mounted on the water flow casing (15B) of the modified overflow pipe (15), an adjustable height pipe nipple (45), a partial flush valve (55), and a pair of flush handles (65 and 70). In order to perform a partial flush, the partial flush handle (70) is pressed and, in order to perform a full flush, the full flush handle (65) is pressed.

10 Claims, 15 Drawing Sheets

TWO-LEVEL WATER FLUSHING DEVICE FOR TOILETS

1. FIELD OF THE ART

Figure 1:
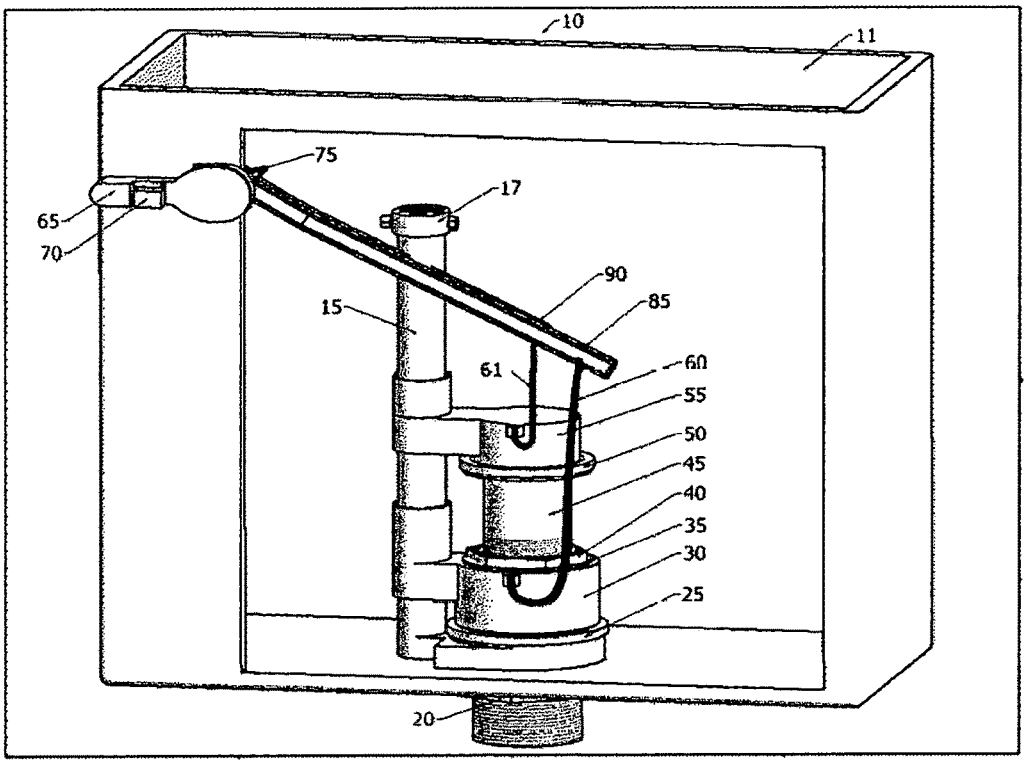

The invention is related to the manufacture of a mechanical hydraulic device for two-level water flush in toilets, dedicated to improve performance in saving water in toilets.

2. PREVIOUS TECHNOLOGY

A toilet is a device that is used for human to attendee physiological needs of disposal liquids and solids waste generated by the body. So its use and scope is widespread in places, such as:

Home
Teaching center (Schools, Colleges, Universities, etc.)
Business
Industries and others.
The main parts of a standard toilet are:
Water storage cistern,
Toilet bowl including siphon,
Water filling device, and
Water flush device
The water filling device includes:
Water inlet valve,
Float ball, and
Bolts, nuts, washers, and others.
The water flush device includes:
Flush handle,
Lever bar,
Chain or rope lifts,
Flush valve which includes frog or pear float,
Overflow pipe,
Bolts, nuts, washers, and others.

Pushing the flush handle, the wastes are brought to the public sewer system. In these toilets for each actuation of the flush handle a release of all content of water in the cistern is done even if the wastes in the toilet bowl are only liquids wastes.

The materials used in their manufacture are ceramics, plastic, metals, and rubber.

Operation

Pushing the flush handle makes leverage on the lever bar that creates a counterclockwise torque which causes the opening of the flush valve, allowing water flush from the cistern to the toilet bowl.

Performed the water flush to the toilet bowl, the flush valve closes by gravity, while the float ball is in its lowest point, and the water inlet valve is open allowing the ingress of water into the cistern. As the water level rises in the cistern the float ball is elevated, until leverage effect on the water inlet valve closes water inlet, leaving the toilet ready again for new water flush. The overflow pipe prevents overflowing water in the cistern by a failure in the water inlet valve or the float ball, causing the water to go to the toilet bowl and then to the public sewer.

Technical Disadvantage

The majority of these toilets, the water flushing volume in the cistern is set by adjusting the length of the rod or arm of the float ball, so when operating the single flush handle a same volume of water is flushing to the toilet bowl in each flush operation and the flush is all the water content in the cistern. Reason why it does not give option to user to makes saving water by carrying out a selective flush, in other words, a partial flush for liquid waste and a full flush for solid waste.

Not allowing to the user to select between a partial flush and a full flush, this system uses excessive and unnecessary volumes of water in majority of cases, so the need for liquid waste disposal is more frequent than the need for solid waste disposal, it is the reason why there is interest in systems that optimize the use of water in toilets.

Nowadays the water is a scarce resource, so the rational use of this resource is an actual necessity for saving this resource and for the environmental protection, especially if we considered the toilet the major water consumers in homes.

3. DESCRIPTION OF THE INVENTION

The two-level water flushing device for toilets, allows the user to select between a partial flush recommended for liquid waste and full flush recommended for solid waste. This device is designed to allow previously set or adjust the volume of water used in the partial flush. The partial and total flushes are performed by pushing one of the two flush handles arranged on the front wall of toilet cistern.

This device is designed to be included as original part of new toilet cisterns or be a replacement unit for cisterns in use.

This device operates in combination with the water drainage of the toilet cistern.

Consists of:

A modified overflow pipe with an elliptical tubular structure,

A flapper valve, called full flush valve, is used for the full flush, has the shape of a cylindrical bell with a flat circular flap with rubber gasket in its lower part, has an inner tubular structure with threads on entire inner surface of this tubular structure, has an internal space to catch air that allows its buoyancy in a full flush, has an elliptical tubular structure for a vertical linear movement without angular displacement on the modified overflow pipe for opening and closing this valve, and is mounted on the water flow casing of the lower structure of the modified overflow pipe, A pipe nipple, called adjustable height pipe, with a flat circular flap in its upper top, with threads on a part of the length of the outer wall, and which is mounted a variable depth in the inner tubular structure of the full flush valve. This pipe nipple allows to set the water volume used in partial flush by varying the threaded depth inside the full flush valve and subsequent adjustment with a nut and gasket, A flapper valve, called partial flush valve, used for partial flush, has the shape of a cylindrical bell with a flat circular flap with rubber gasket in its lower part, has an internal space to catch air that allows its buoyancy in a partial flush, has an elliptical tubular structure for a vertical linear movement without angular displacement on the modified overflow pipe for opening and closing this valve, and is mounted on adjustable height pipe, and A pair of concentric and axial flush handles mounted in the front wall of the toilet cistern with their respective lever bars and lift chains or ropes, The output of the water from the cistern to the toilet bowl in a full flush is performed through the opening in the water flow casing of the modified overflow pipe, while a partial flush is performed through the adjustable height pipe and the inner tubular structure of the full flush valve, The both flush valves have like a common axis for vertical linear movement without angular displacement to the elliptical tubular structure of the modified overflow pipe. The main objective of this invention is to provide a device that allows the user to save water by selecting between a partial flush recommended for liquids waste and a full flush recommended for solids waste. Also the purpose of this invention is to provide a device that:

1) provide a new mechanism of two-level water flushing for toilet cisterns, in a new and different configuration,
2) allow saving water in toilets choosing between two water levels without losing sanitary purposes,
3) easy to use,
4) easy to install, without the need for modifications in the toilet cisterns,
5) it can be installed in a variety of models and sizes of toilet cisterns,
6) it can be used as a replacement unit in toilet cisterns in use or it can be mounted on new toilet cisterns,
7) to be a high performance and profitable for both the manufacturer and the consumer, and
8) to be an device that contributes to environmental protection.

These and other objects and advantages of the present invention will become evident from the following description of the preferred embodiment and the claims in conjunction with the accompanying drawings

4. DESCRIPTION OF THE DRAWINGS

Figure 2:
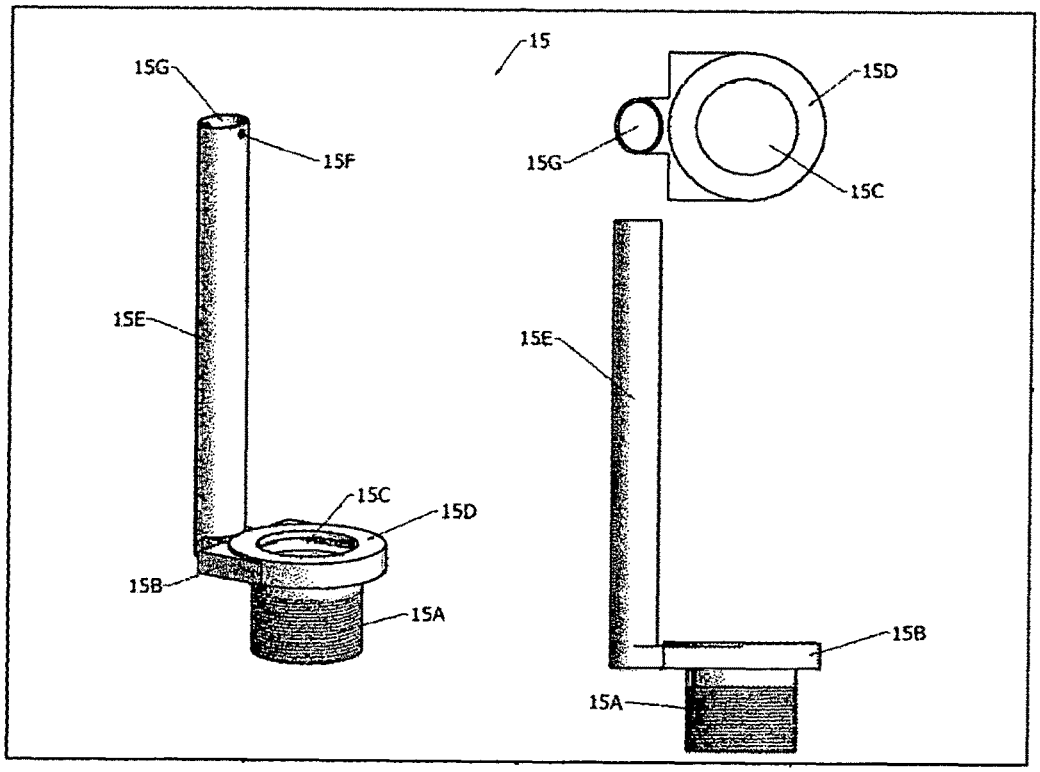
Figure 3:
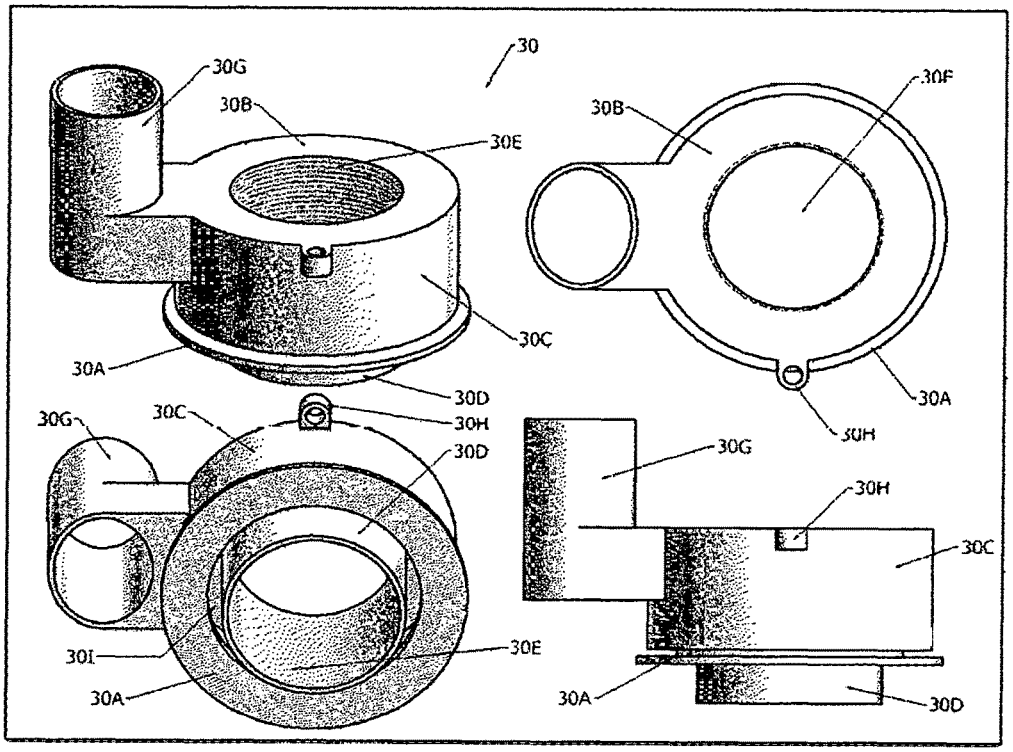
Figure 4:
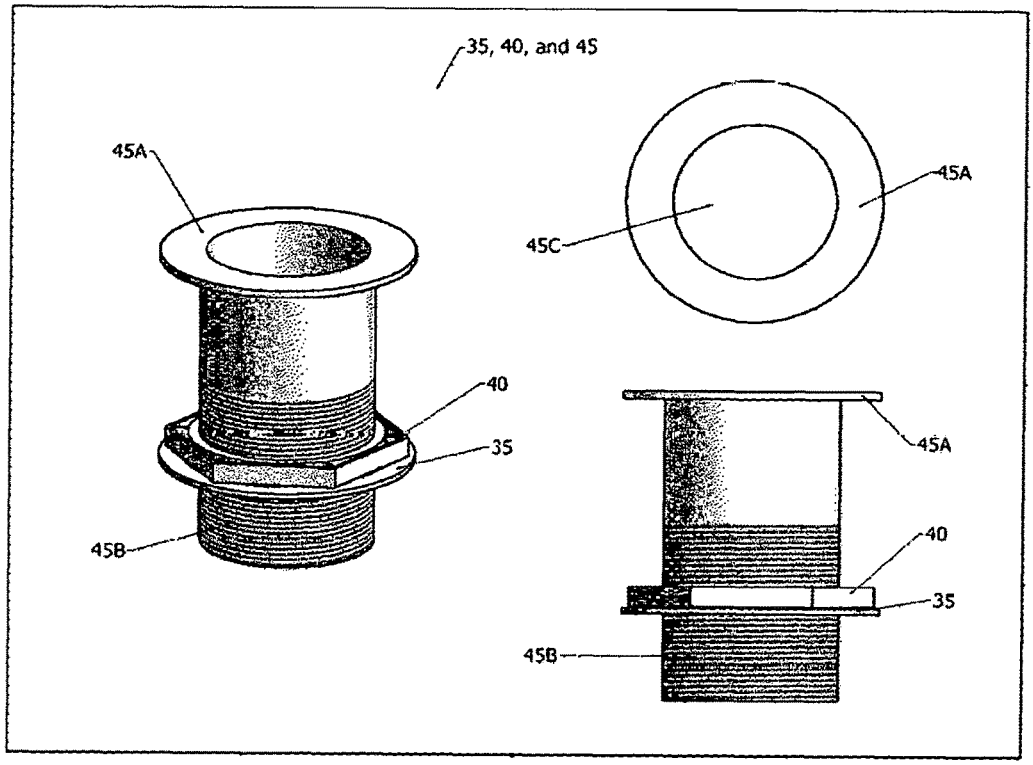
Figure 5:
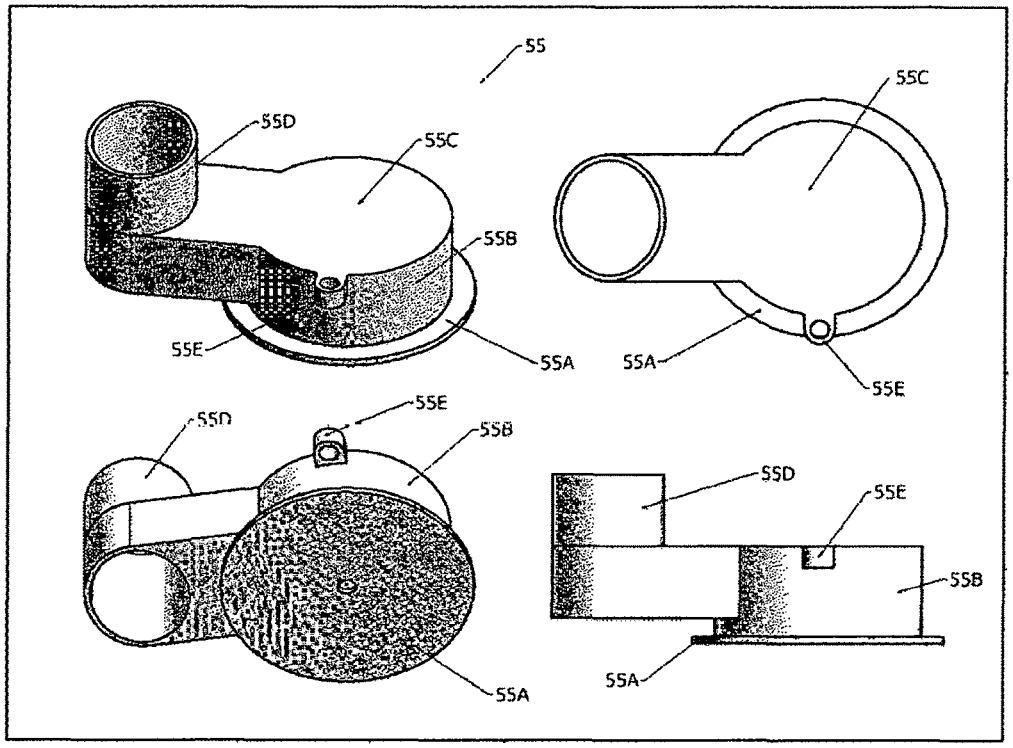
Figure 6:
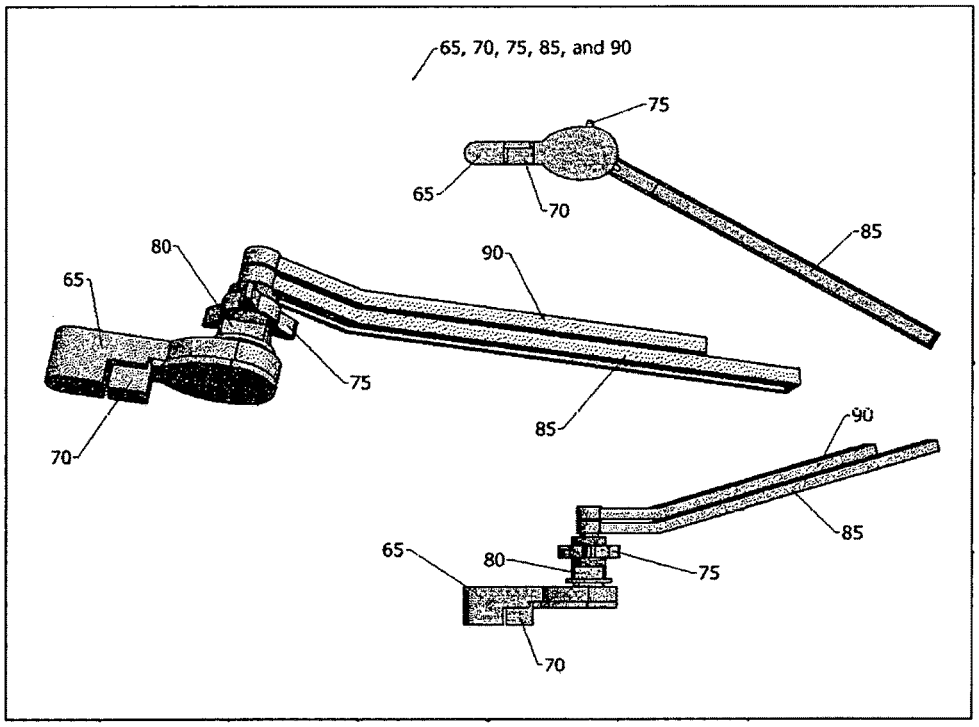
Figure 7:
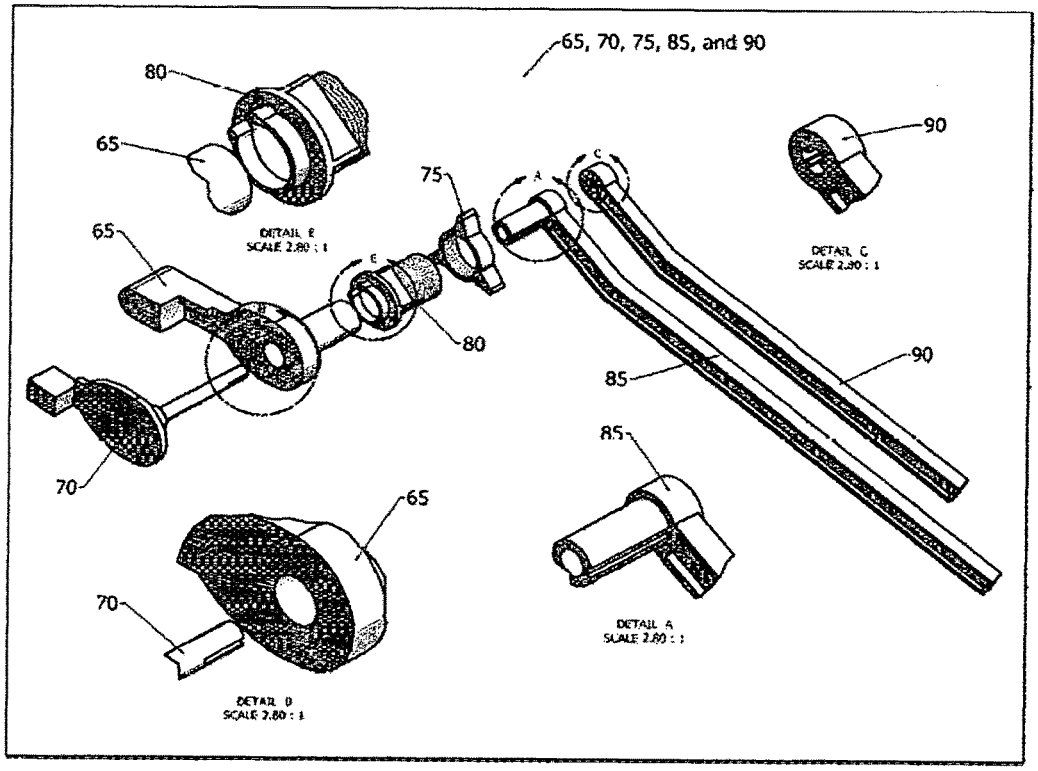
Figure 8:
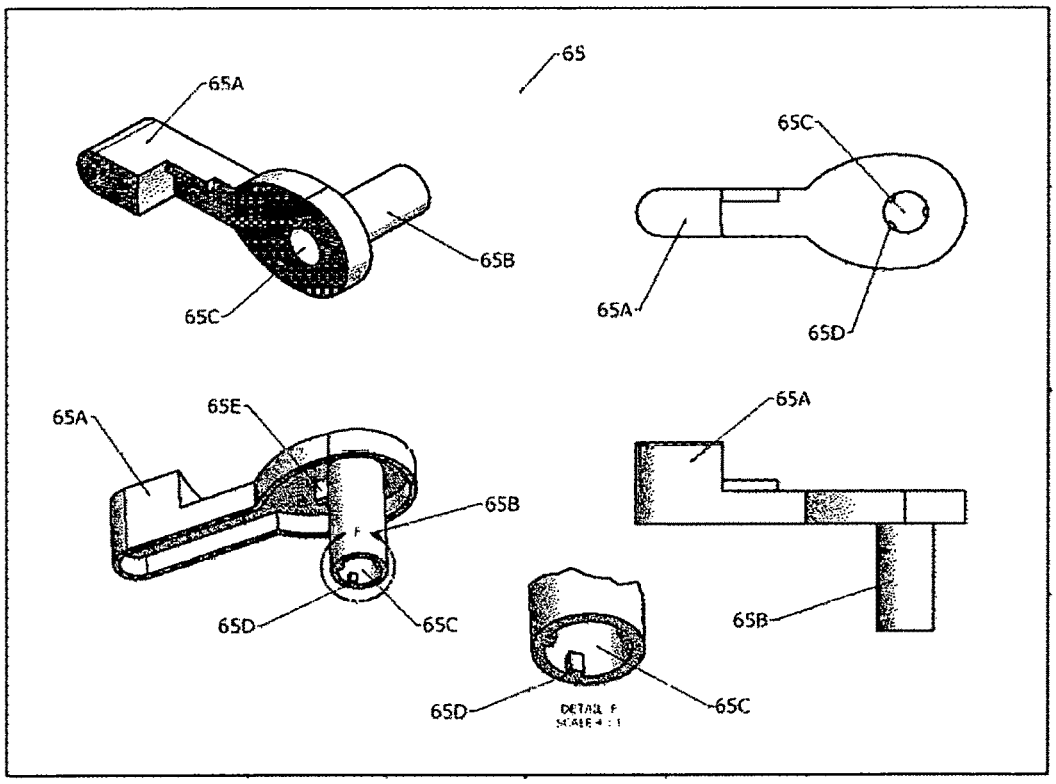
Figure 9:
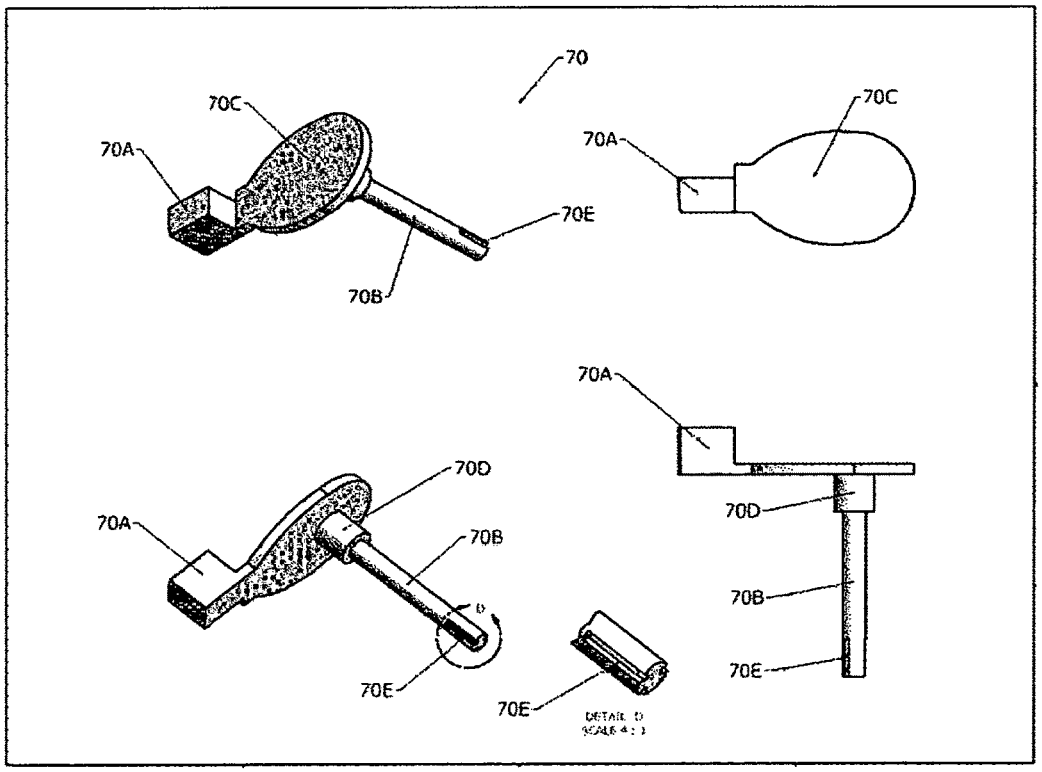
Figure 10:
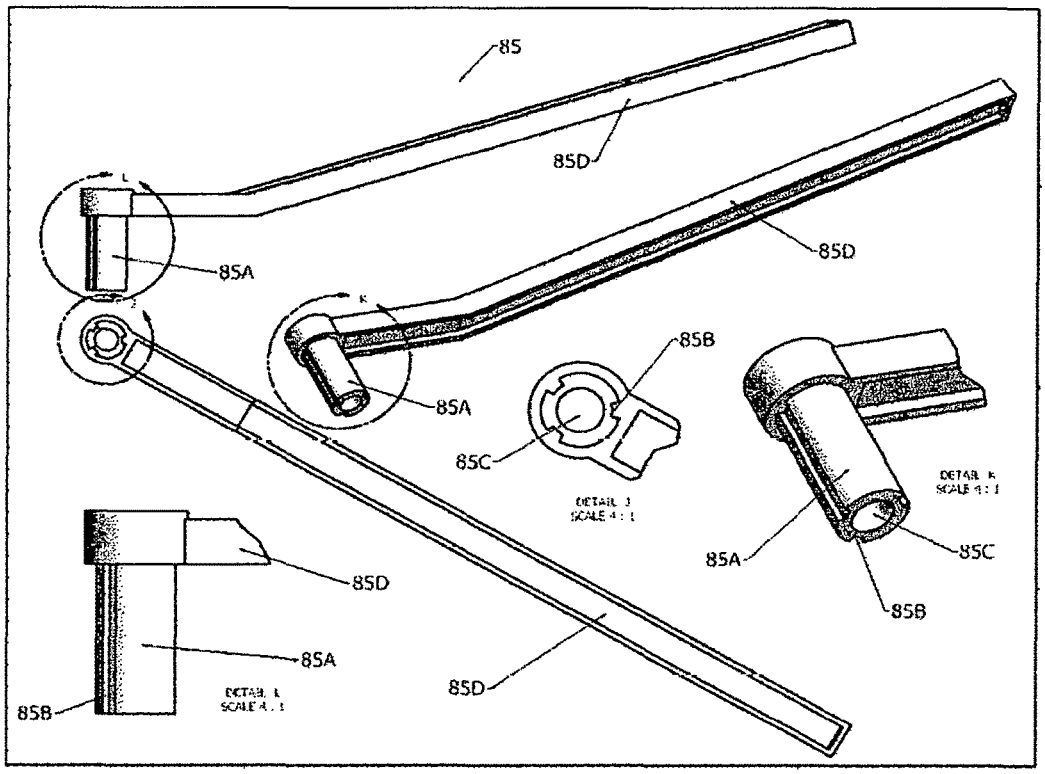
Figure 11:
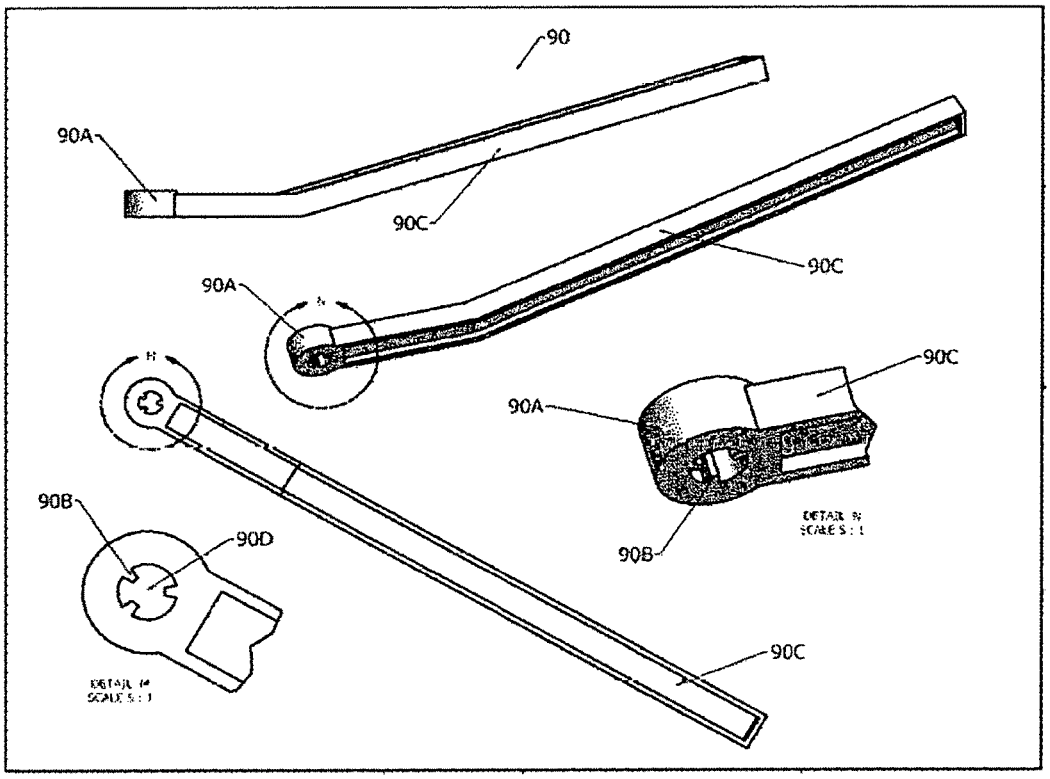
Figure 12:
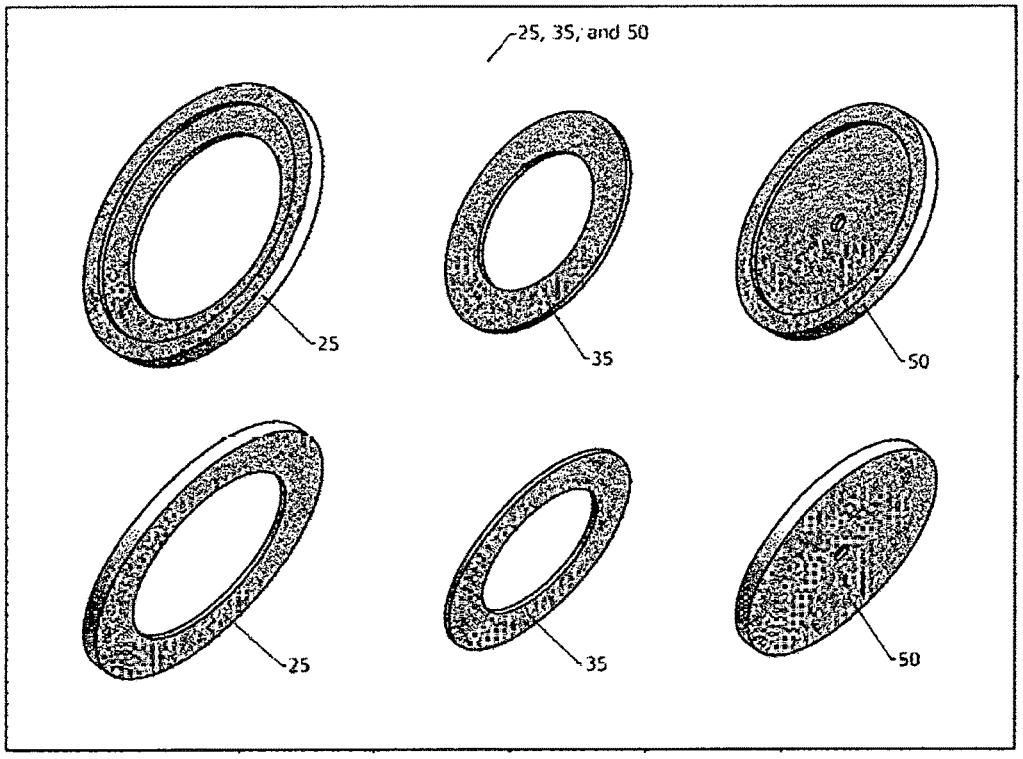
Figure 13:
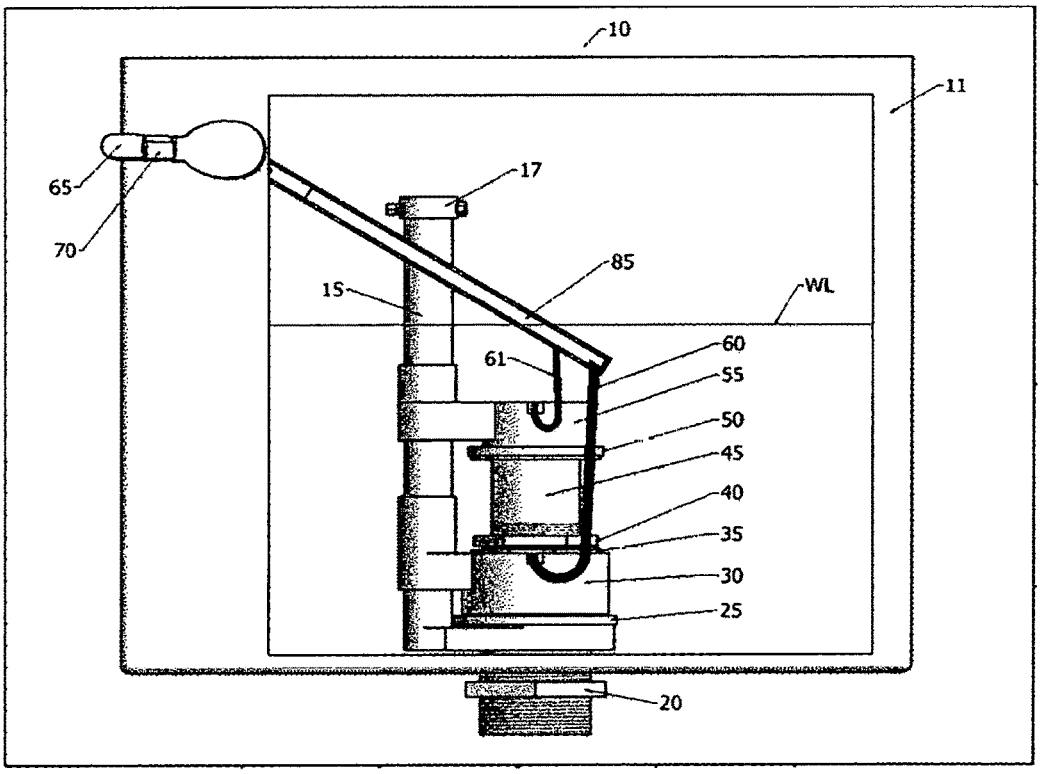
Figure 14:
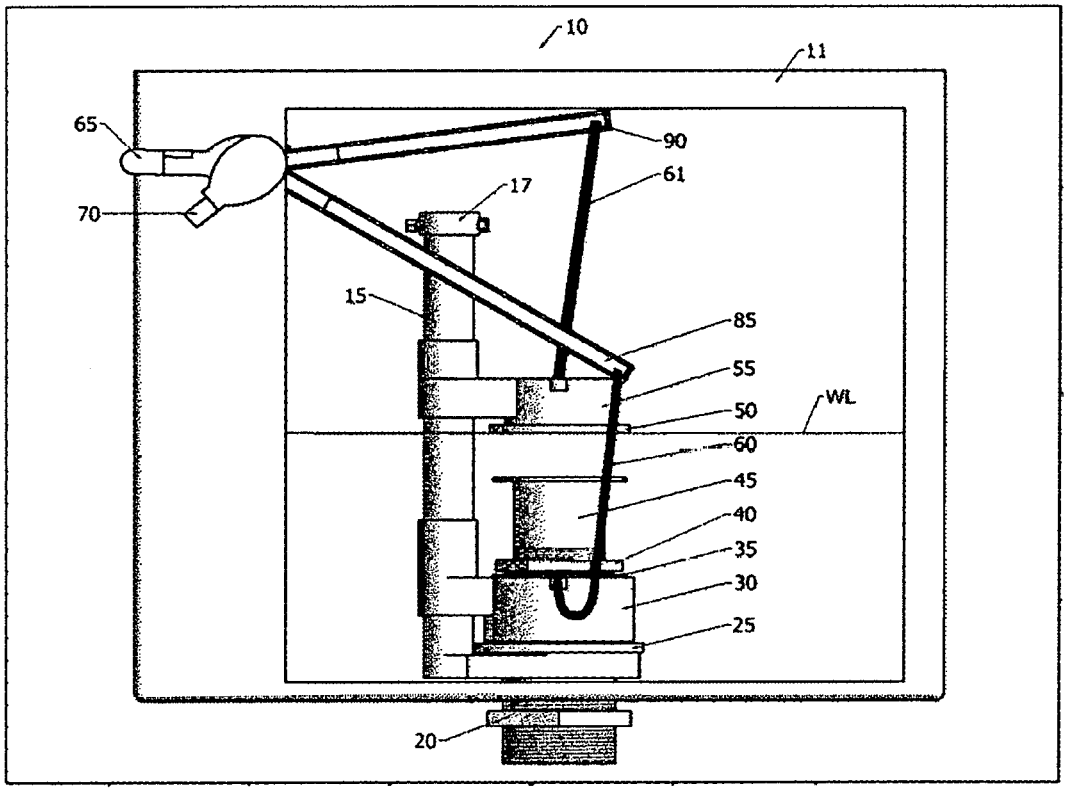
Figure 15:
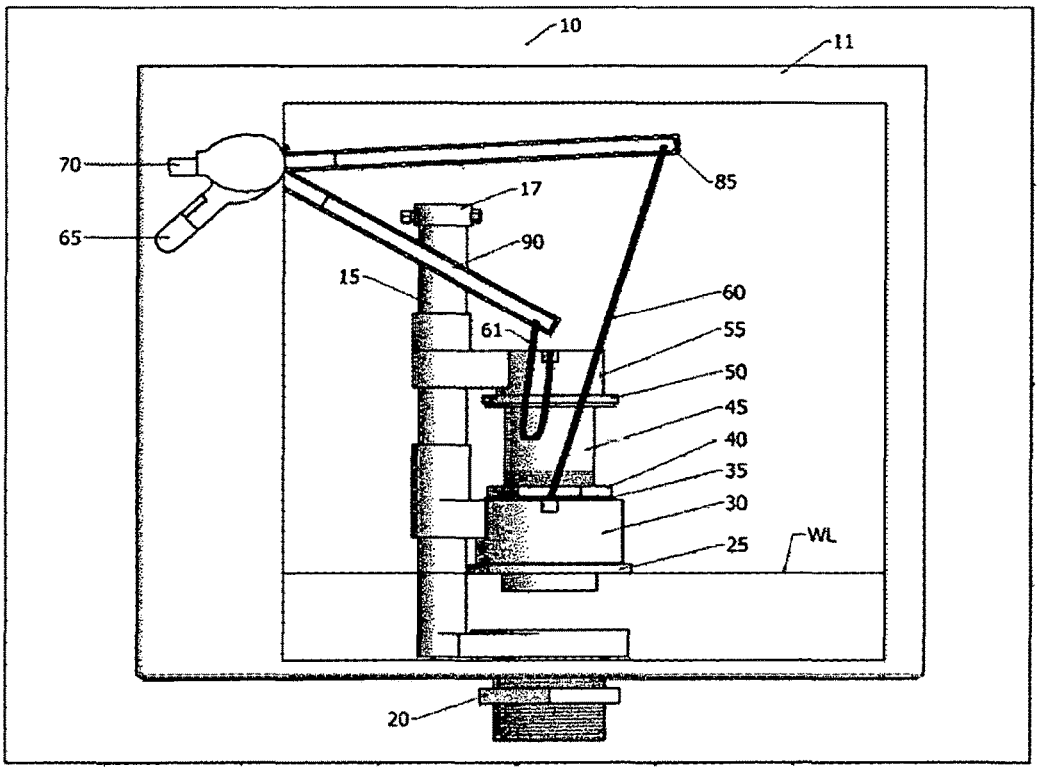

Other features and advantages of the present invention will become apparent from a description of each of the parts with reference to the accompanying drawings, in which:

FIG. 1 is a schematic view of the invention mounted in the toilet's water storage cistern; the cistern is cut off for a better understanding, FIG. 2 shows the modified overflow pipe in one isometric view, one top view, and one lateral view, FIG. 3 shows the full flush valve in two isometric views, one top view, and one lateral view, FIG. 4 shows the adjustable height pipe in one isometric view, one top view, and one lateral view, FIG. 5 shows the partial flush valve in two isometric views, one top view, and one lateral view, FIG. 6 shows the assembly of flush handles with their lever bars and assembly accessories in one isometric view, one top view, and one lateral view, FIG. 7 shows the disintegrated assembly of flush handles with their lever bars and assembly accessories in one isometric view, and four detail views, FIG. 8 show the full flush handle in two isometric views, one top view, one lateral view, and one detail view, FIG. 9 show the partial flush handle in two isometric views, one top view, one lateral view, and one detail view, FIG. 10 show the full flush lever bar in one isometric view, one top view, one lateral view, and three detail views, FIG. 11 show the partial flush lever bar in one isometric view, one top view, one lateral view, and two detail views, FIG. 12 shows gaskets of the full flush valve, of the adjustable height pipe, and of the partial flush valve FIG. 13 is a front view of the flushing mechanism with Water Level (WL) in the storage cistern at full load of water, FIG. 14 is a front view of the flushing mechanism with the partial flush handle activated for a partial flush, FIG. 15 is a front view of the flushing mechanism with the full flush handle activated for a full flush.

5. PREFERRED EMBODIMENT OF THE INVENTION

The best way to implement this two-level water flushing device for toilets 10 is to be presented in terms of a preferred embodiment designed to allow the user to choose between a partial flush of previously set water volume and a full flush of all the water content in the toilet cisterns.

The preferred embodiment of this device 10 is as shown in FIGS. 1 to 15, comprising five major elements: a modified overflow pipe 15, a full flush valve 30, an adjustable height pipe 45, a partial flush valve 55, and a pair flush handles 65 and 70. This device is designed to be installed in toilet cisterns 11 incorporating a water inlet valve with its respective ball float. All these major elements may be constructed preferably of plastic or also some metal resistant to corrosion.

The modified overflow pipe 15 is shown in FIG. 1 mounted between the water cistern 11 and the toilet bowl, and in detail in FIG. 2. This modified overflow pipe 15 consist of an elliptical tubular structure 15E in which lower end has a water flow casing 15B, the same having in its upper part a flat surface 15D with a cavity or circular hole 15C for the passage of water, and in the lower part has a flat surface from which it derives a circular threaded 15A for the passage of water to the toilet bowl and for fixing the modified overflow pipe 15 with the base of the water cistern 11.

The reason why the tubular structure is elliptical responds to the necessity that the vertical linear movements for opening and closing of the flush valves, these valves do not suffer angular displacements, and can perform an effective seal.

The full flush valve 30 is shown in FIG. 1 mounted on the water flow casing 15B of the modified overflow pipe 15, and in detail in FIG. 3. This valve consists of an outer cylindrical structure bell shaped 30C with a lower flat circular flap 30A, with a rubber gasket assembly 25 in the flat circular flap 30A, with a upper flat circular surface 30B with a concentric cavity or circular hole 30F, with a circular inner tubular structure 30D built in the cavity or hole 30F and with the same diameter to it, with a thread 30E on the entire inner surface of the tubular structure 30D, with an internal space 30I which allows air capture for buoyancy in a full flush, with an elliptical tubular structure for vertical linear movement without angular displacement 30G around the elliptical tubular structure 15E of the modified overflow pipe 15, with a fixing strap 30H in which is fixed the chain or rope lift 60, and which is mounted on the water flow casing 15B of the modified overflow pipe 15. The inner circular tubular structure 30D is used for the passage of water to the toilet bowl in a partial flush, maintaining the internal space 30I and the inside water flow casing 15B of the modified overflow pipe 15 with air at atmospheric pressure.

The adjustable height pipe 45 is shown in FIG. 1 mounted in the full flush valve 30, and in detail in FIG. 4 in which is shown assembled with an adjustment bolt 40 and a sealing gasket 35. The adjustable height pipe 45 has a flat circular flap 45A in its upper part whose purpose is to provide support base for the partial flush valve 55, also has a threaded 45B portion on its outer tubular surface that is used to screw to varying depth into the inner circular tubular structure 30D of the full flush valve 30 in order to set the volume of water used in the partial flush. The inner free part 45C of this pipe nipple is used for the passage of water to the toilet bowl in a partial flush, maintaining the internal space 30I of the full flush valve 30 and the interior of the water flow casing 15B of the modified overflow pipe 15 with air at atmospheric pressure.

The partial flush valve 55 is shown in FIG. 1 mounted on adjustable height pipe 45, and in detail in FIG. 5. This valve consists of a cylindrical structure cylindrical bell shape 55B with a flat circular flap 55A, with a rubber gasket assembly 50 in the flat circular flap 55A, with a upper flat circular surface 55C, with an internal space 55E that allow capture the air for buoyancy in a partial flush, with an elliptical tubular structure for vertical linear movement without angular displacement 55D around the elliptical tubular structure 15E of the modified overflow pipe 15, with a fixing strap 55E in which is fixed the chain or rope lift 61, and which is mounted on the flat circular flap 45A of the adjustable height pipe 45.

When the toilet cistern 11 is full load of water and ready for a new flush, the modified overflow pipe 15, the full flush valve 30, the adjustable height pipe 45, and the partial flush valve 55 maintains an internal common space with air at atmospheric pressure. This internal common space to atmospheric pressure allows register a positive relative pressure (gauge) over the valves 30 and 55, which keeps them closed and sealed. Because the water column at the level of the flapper 30A of the full flush valve 30 is greater than the water column at the level of the flapper 55A of the partial flush valve 55, the total gauge pressure on valve 30 will be greater than the gauge pressure on the partial flush valve 55, therefore, the force or torque required for opening the full flush valve 30 will be greater than the force or torque required for opening the partial flush valve 55. In a partial flush the passage of water to the toilet bowl is directly through the adjustable height pipe 45C and the circular tubular structure 30D of the full flush valve 30, and does not pass through the water flow casing 15B of the modified overflow pipe 15, reason why in the interior of the water flow casing 15B and the internal space 30I of the of the full flush valve 30 maintains air at atmospheric pressure, making the full flush valve 30 continue close by the gauge pressure on the flap 30A. In a full flush the passage of water to the toilet bowl is directly through the water flow casing 15B of the modified overflow pipe 15.

The full flush handle 65 is shown in FIG. 1 mounted on the front surface of the toilet cistern 11 and in detail in FIGS. 6, 7, and 8. The full flush handle 65 is articulated with the upper end 85A of the full flush lever bar 85, the same that in its lower end is articulated to the fixing strap 30H of the full flush valve 30 by a chain or rope lift 60. A free space 65C runs along the central axis of the full flush handle 65, which has three gear teeth 65D arranged in the interior of the free space 65C for the articulation with the upper end 85A of the full flush lever bar 85.

The full flush lever bar 85 is shown in FIG. 1, and in detail in FIGS. 6, 7 and 10. This full flush lever bar 85 has a cylindrical structure 85A in its upper end, having three longitudinal slots 85B for articulation with the gear teeth 65D of the full flush handle 65.

The partial flush handle 70 is shown in FIG. 1 mounted on the front surface of the toilet cistern 11 and in detail in FIGS. 6, 7, and 9. This partial flush handle 70 is mounted in the free space 65C of the full flush handle 65, articulated to the upper end 90A of the partial flush lever bar 90, the same that in its lower end is articulated to the fixing strap 55E of the partial flush valve 55 by a chain or rope lift 61. A solid central axis 70B of the partial flush handle 70 runs along the free space 65C of the full flush handle 65, the same that has three slots 70E for the articulation with the gear teeth 90B of the partial flush lever bar 90.

The partial flush lever bar 90 is shown in FIG. 1 and in detail in FIGS. 6, 7, and 11. This partial flush lever bar 90 has a ringed structure 90A in its upper end, the same that has three gear teeth 90B for the articulation with the slots 70E of the partial flush handle 70.

A stop fitting 17 on the upper side of the overflow pipe which limits the movement of the valves upwards.

6. OPERATION

The two-level water flushing device for toilets 10 is designed to provide the user a partial flush of a previously set water volume and a full flush of all the water content in the toilet cistern. Prior to the flushing operation by any of the flush handles 65 and 70, the water level WL in the toilet cistern 11 must be at full load of water and the flushing device 10 must be as is shown in FIG. 13. As shown, the full flush valve 30 is making a hermetic seal with the water flow casing 15B of the modified overflow pipe 15, in the inner tubular structure 30D of the full flush valve 30 is screwed the adjustable height pipe 45, the flat circular flap 45A of the adjustable height pipe 45 is making a hermetic seal with the partial flush valve 55, and the flush handles 65 and 70 are in standby.

A water flushing is carried out by performing the following steps:

1) Partial Flush—a partial flush of a previously set volume of water is performed by pushing down the flush handle 70. When the partial flush handle 70 is pushed as shown in FIG. 14, a leverage is generated on the partial flush lever bar 90 that creates a counterclockwise torque on the chain or rope lift 61 that performed a vertical linear movement upwards without angular displacement by the elliptical tubular structure 15E of the modified overflow pipe 15 for the opening of the partial flush valve 55, starting the water flush to the toilet bowl, the air captured inside the partial flush valve 55 keeps it floating while the water is flushing, when the water level WL in the toilet cistern 11 reaches the level of the flat circular flap 45A of the adjustable height pipe 45 the union of this flap 45A with the flap 55A of the partial flush valve 55 creates a hermetic seal, thus restarting the filling of water into the toilet cistern 11.
2) Full Flush—a full flush of water is performed by pushing down the flush handle 65. When the full flush handle 65 is pushed as shown in FIG. 15, a leverage is generated on the full flush lever bar 85 that creates a counterclockwise torque on the chain or rope lift 60 that performed a vertical linear movement upwards without angular displacement by the elliptical tubular structure 15E of the modified overflow pipe 15 for the opening of the full flush valve 30, starting the full water flush to the toilet bowl, the air captured inside the full flush valve 30 keeps it floating while the water is flushing, when the water level WL in the toilet cistern 11 reaches the level of the upper flat surface 15D of the water flow casing 15B of the modified overflow pipe 15 the union of this flat surface 15D with the flap 30A of the full flush valve 30 creates a hermetic seal, thus restarting the filling of water into the toilet cistern 11.

The invention claimed is:

1. A partial or total water flushing device for toilet (11), having:

an overflow pipe (15) which has in its lower part a water flow casing (15B) with a plane surface (15D) with a cavity for the passage of water;

a full flush valve on the overflow pipe; and a partial flush valve on the full flush valve;

comprising:

a tubular structure (30D) of a full flush flap valve (30) which crosses an internal space (301) of air for buoyancy, wherein the full flush flap valve (30) is mounted on the overflow pipe (15), a flapper (30A) of the full flush flap valve (30) which is on the on the plane surface (15D), the tubular structure (30D) which crosses in partially or totally way the internal space of the water flow casing (15B), and the internal space (30I) which is in communication with the internal space of the water flow casing (15B);

a pipe nipple (45) which is assembled between the full flush flap valve (30) and a partial flush flap valve (55), which is inserted to adjustable depth in the tubular structure (30D) setting the volume of water of the partial flushing;

the partial flush flap valve (55) which has a first tubular structure (55D) which slides on the overflow pipe (15);

the full flush flap valve (30) which has a second tubular structure (30G) which slides on the overflow pipe (15);

the partial flush flap valve (55) which has a first clamping ear (55E) to which is clamped a first lifting chain which communicates with a first flush actuator; and the full flush flap valve (30) which has a second clamping ear (30H) to which is clamped a second lifting chain which communicates with a second flush actuator.

2. The device according to claim 1, wherein the cross-section of the pipe nipple (45) and the cross-section of the tubular structure (30D) which are circular, elliptical or another geometrical shape.

3. The device according to claim 2, wherein the pipe nipple (45) which presents a circular shaped cross-section with an external thread (45B) and which is screwed in the tubular structure (30D) which also presents a circular shaped cross-section with an internal thread (30E).

4. The device according to claim 1, wherein the cross-section of an external structure (30C) of the full flush flap valve (30) and the cross-section of an external structure (55B) of the partial flush flap valve (55) which are circular, elliptical or another geometrical shape.

5. The device according to claim 1, wherein it is operated with the first flush actuator and the second flush actuator which are assembled on the front surface, back surface, lateral surface, or upper surface of the toilet cistern (11).

6. The device according to claim 5, wherein the first flush actuator and the second flush actuator are an assembly of flush buttons.

7. The device according to claim 1, wherein the clamping ear of the partial flush flap valve and the clamping ear of the full flush flap valve which are located on the sliding tubes.

8. The device according to claim 1, wherein the cross-section of the overflow pipe (15), the cross-section of the sliding tube of the partial flush flap valve, and the cross-section of the sliding tube of the full flush flap valve which are circular, elliptical or another geometrical shape.

9. The device according to claim 1, comprising multiple parallel overflow pipes (15), and wherein the partial flush flap valve and the full flush flap valve also comprise multiple parallel sliding tubes.

10. The device according to claim 1, comprising a stop fitting (17) on the upper side of the overflow pipe which limits the movement of the valves upwards.

* * * * *